US005234885A

United States Patent [19]

Hayashi et al.

[11] Patent Number: 5,234,885

[45] Date of Patent: Aug. 10, 1993

[54] THERMAL TRANSFER IMAGE-RECEIVING SHEET

[75] Inventors: Shigeo Hayashi; Akio Mishiba; Takaharu Miura, all of Tokyo, Japan

[73] Assignee: Oji Paper Co., Ltd., Tokyo, Japan

[21] Appl. No.: 689,578

[22] Filed: Apr. 23, 1991

[30] Foreign Application Priority Data

Apr. 24, 1990 [JP] Japan ..... 2-106538

[51] Int. Cl.[5] ..... B41M 5/035; B41M 5/38

[52] U.S. Cl. ..... 503/227; 428/195; 428/423.1; 428/447; 428/497; 428/500; 428/913; 428/914

[58] Field of Search ..... 8/471; 428/480, 497, 428/498, 500, 913, 914, 423.1; 503/227

[56] References Cited

FOREIGN PATENT DOCUMENTS 61-281119 12/1986 Japan ..... 428/500

OTHER PUBLICATIONS

"Chemistry and Technology of UV and EB Formulation for Coatings, Inks, and Paints", vol. 4, Formulation, Braithwaite et al., 1991, pp. 288-290.

*Primary Examiner*—B. Hamilton Hess

*Attorney, Agent, or Firm*—Armstrong, Westerman, Hattori, McLeland & Naughton

[57] ABSTRACT

A thermal transfer image-receiving sheet for recording thereon colored dye images having a high clarity and color density and an excellent storage durability, comprises an image-receiving resinous layer formed on a substrate sheet and comprising a resinous material which is an actinic ray irradiation curable product of a precursory resinous composition comprising (A) an unsaturated acrylic or methacrylic ester compound having a rosin or modified rosin residue, (B) another acrylic or methacrylic ester compound having a bisphenol A residue, at least one ethylene glycol residue and at least two terminal acrylic or methacrylic ester residue, and optionally (C) still another unsaturated acrylic or methacrylic ester compound having a single terminal acrylic or methacrylic ester residue.

12 Claims, No Drawings

THERMAL TRANSFER IMAGE-RECEIVING SHEET

BACKGROUND OF THE INVENTION

1.) Field of the Invention

The present invention relates to a thermal transfer image-receiving sheet. More particularly, the present invention relates to a thermal transfer image-receiving sheet capable of recording thereon sublimating dye images having an excellent clarity and gloss, at a high sensitivity.

2.) Description of the Related Arts

Currently there is an enormous interest in the development of dye thermal transfer type printers as a color hand copier for recording high quality colored images.

In the dye thermal transfer type printing system, an ink sheet composed of a base film and a yellow, cyan or magenta dye layer coated on a surface of the base film is superimposed on an image-receiving sheet composed of a substrate sheet and an image receiving resinous layer formed on a surface of the substrate sheet in such a manner that the dye layer of the ink sheet comes into direct contact with the image-receiving resinous layer of the image-receiving sheet, and the ink sheet is locally heated by heat applied by a thermal head of the printer, whereby portions of the dye in the ink sheet are thermally transferred to the image-receiving resinous layer to provide colored images. In this thermal transfer procedure of the colored images, the heating operation of the thermal head is continuously controlled in accordance with electrical signals corresponding to the images or pictures to be recorded, and the amount of dye transferred from the ink layer to the image-receiving layer is continuously controlled in accordance with the amount of heat and the heating time applied by the thermal head, to print continuous tone full color images having a desired color density 54 (darkness) on the image-receiving resinous layer.

In conventional dye image-receiving sheets, the dye image-receiving resinous layer comprises, as a principal component, a substrated copolyester resin having a high affinity to sublimating dyes.

A colored image-forming mechanism of the dye image thermal transfer printing system is described in "Shikizai (Coloring materials)", vol. 59, No. 10, 1986, pages 607. In this mechanism, when an image-receiving polyester resinous layer having a relatively low glass transition temperature is locally heated, vigorous molecular motions (vibrations) occur in portions of the polyester molecule chains of the polyester resin located in the heated portions of the image-receiving layer and these portions are melted or softened to form viscous liquid layer portions. Also, in the printing procedure, the dye in the ink layer is locally sublimated and the sublimated dye penetrates the melted or softened polyester resinous layer portions. When the polyester resinous layer portions are solidified by cooling, the penetrated dye is embedded in and fixed to the solidified amorphous portions of the polyester resinous layer portions, to thereby provide colored images.

Nevertheless, the colored images recorded by the dye thermal transfer printing system are disadvantageous in that such recorded images have a low color evenness and density (darkness), and a poor durability during storage.

To eliminate the above-mentioned disadvantages, an attempt has been made to increase the surface smoothness of the image-receiving resinous layer, to thereby enhance a close adhesion of the dye layer surface of the ink sheet to the image-receiving resinous layer surface of the image-receiving sheet, and thus raise the printing speed of the image-receiving sheet and improve the quality of the resultant colored images. For example, Japanese Unexamined Patent Publication No. 62-211,195 discloses an attempt to provide an image-receiving resinous layer having a high surface smoothness, by coating a substrate sheet surface with an aqueous coating liquid by a casting method. This attempt provides an image-receiving resinous layer with a high surface gloss but is disadvantageous in that, since the aqueous coating liquid layer formed on a cast drum surface is solidified by evaporating off water in the aqueous coating liquid layer, the resultant image-receiving resinous layer contains a number of pores derived from the evaporation of the water, and thus the surface smoothness and uniformity of the image-receiving resinous layer is not satisfactory and the resultant colored images on the image-receiving resinous layer exhibit an unsatisfactory color density (darkness) evenness.

Also, Japanese Unexamined Patent Publication No. 62-173,295 discloses an image-receiving resinous layer formed by coating a surface of a substrate sheet with a coating liquid containing a radical-polymerizable oligomer or monomer which can be used by an actinic ray irradiation, and applying the actinic ray irradiation to the coating liquid layer on the substrate sheet surface.

This technique is advantageous in that the resultant image-receiving resinous layer has a high gloss, but is disadvantageous in that the cured resin in the resultant image-receiving resinous layer is crosslinked at a high cross-linkage density, and thus cannot be melt-softened to form a viscous liquid layer when heated in the thermal transfer printing procedure, and therefore, the resultant image-receiving resinous layer exhibits a poor dye-receiving activity and it is difficult to record thereon clear colored images having a high color density (darkness).

SUMMARY OF THE INVENTION

An object of the present invention is to provide a thermal transfer image-receiving sheet having an image-receiving resinous layer free from pores or voids formed therein, having a high surface smoothness, and capable of recording thereon clear colored images at a high color density.

Another object of the present invention is to provide a thermal transfer image-receiving sheet having an image-receiving resinous layer formed by an actinic ray irradiation curing method and capable of recording thereon clear colored images having an excellent storage durability and a high evenness of the color density.

The above-mentioned objects can be attained by the thermal transfer image-receiving sheet of the present invention, which comprises a substrate sheet and an image-receiving resinous layer formed on at least one surface of the substrate sheet and comprising, as a principal component, a resinous material cured by an actinic ray irradiation in the presence of a photochemical initiator, the resinous material consisting of an actinic ray irradiation curing product of a precursor resinous composition comprising:

(A) a first component consisting of at least one member selected from unsaturated acrylic and methacrylic ester compounds having at least one radical selected from a rosin residue, disproportionation-modified rosin residues and hydrogenated rosin residue; and (B) a second component consisting of at least one member selected from unsaturated acrylic and methacrylic ester compounds having a bisphenol A residue, at least one ethylene glycol residue and at least two terminal radicals selected from acrylic and methacrylic ester residues, and other than those of the first component (A).

DESCRIPTION OF THE PREFERRED EMBODIMENTS

The thermal transfer image-receiving sheet of the present invention comprises a substrate sheet and an image-received resinous layer formed on at least one surface of the substrate sheet.

The image-receiving resinous layer comprises, as a principal component, a resinous material cured by an actinic ray irradiation, for example, an electron beam or ultraviolet ray irradiation, in the presence of a photochemical initiator.

This cured resinous material is prepared by an irradiation of an actinic ray to a precursor resinous composition.

This precursory resinous composition comprises a mixture of a first component (A) with a second component (B).

The first component (A) consists of at least one member selected from unsaturated acrylic and methacrylic ester compound having one or more members selected from rosin residue, disproportionation-modified rosin residues and hydrogenated rosin residues.

Also, the second component (B) consists of at least one member selected from unsaturated acrylic and methacrylic ester compound having a bisphenol A residue, at least one ethylene glycol residue, and at least two terminal radicals selected from acrylic and methacrylic ester residues, and other than those of the first component (A).

Generally, a precursory resinous composition contains at least one actinic ray-curable unsaturated resinous compound, for example, polyester acrylates and methacrylates, urethane acrylates and methacrylates and epoxy acrylates and methacrylates each having at least one acryloyl radical or methacryloyl radical.

When the precursory resinous composition is subjected to an actinic ray irradiation, activated seeds (radicals) are created in the unsaturated resinous compound, and thus the precursory resinous composition is instantaneously converted to a cured and cross-linked polymeric material. The resultant resinous material has a network-like cross linkage and exhibits a high surface gloss, heat resistance and abrasion resistance.

When an image-receiving resinous layer is formed from the network cross-linked resinous material, the molecular movement of polymeric molecules in the resinous material restricted, even at a high temperature, by the cross-linkage, and thus the cross-linked resinous material layer cannot be melt-softened to form a viscous liquid layer. Therefore, this non-softened resinous material restricts the penetration of the sublimated dye from the dye layer of the ink sheet, and therefore, the resultant dye images on the cured resinous material layer have a low color density (darkness) and are not clear.

If the dye-receiving property of the cured resinous material layer is improved by lowering the degree of cross-linkage, the resultant cured resinous material layer exhibits a poor heat resistance and a low gloss.

This cured resinous material layer frequently causes the resultant image-receiving sheet to be adhered to the ink sheet, and thus the travel of the, image-receiving sheet in the printer is abstructed.

The above-mentioned disadvantages of the conventional image receiving resinous layer can be eliminated by using the specific actinic ray irradiation-cured resinous material of the present invention.

In the precursory resinous composition usable for the present invention, the unsaturated acrylic and methacrylic ester compounds of the first component (A) must have at least one specific moiety selected from a rosin residue, disproportionation-modified rosin residues and hydrogenated rosin residues. Note, the unsaturated acrylic and methacrylic ester compounds of the first component (A) naturally have at least one unsaturated terminal radical selected from acrylic and methacrylic ester residues of the formulae:

$$-COCH{=}CH_2 \text{ and}$$

$$-COC(CH_3){=}CH_2$$

The unsaturated acrylic and methacrylic compounds of the first component (A) are preferably selected from reaction products of:

(a) an ingredient consisting of at least one reaction product of at least one member selected from acrylic and methacrylic acids with at least one member selected from rosin glycidylesters, disproportionation-modified rosin glycidylesters and hydrogenated rosin glycidylesters, with (b) an ingredient consisting of at least one diisocyanate compound, and (c) an ingredient consisting of at least one member selected from:

(i) reaction products of at least one member selected from acrylic and methacrylic acids with at least one diepoxide component, and (ii) acrylic and methacrylic compound having at least one hydroxyl radical.

The ingredient (a) preferably consists of at least one compound of the formula (I):

$$R_1{-}COOCH_2\underset{\underset{OH}{|}}{C}HCH_2OCO\overset{\overset{R_2}{|}}{C}{=}CH_2 \qquad (I)$$

wherein $R_1$ represents a member selected from the group consisting of a disproportionation-modified rosin residue and a hydrogenated resin residue, and $R_2$ represents a member selected from the group consisting of a hydrogen atom and a methyl radical.

In the disproportionation-modified rosin and the hydrogenated rosin, the conjugated double bond of the rosin is modified to a stabilized form.

The ingredient (b) consists of at least one diisocyanate compound selected from conventional compounds; preferably from diphenyl-methane diisocyanate, isophorone diisocyanate, hexamethylene diisocyanate, phenylene diisocyanate, and tolylene diisocyanate.

In the ingredient (c), the reaction product (i) of at least one member selected from acrylic and methacrylic acids with at least one diepoxide component is preferably selected from the compounds of the formula (II):

$$CH_2{=}C(R_3)COOCH_2CH(OH)CH_2{-}D{-}CH_2CH(OH)CH_2OCOC(R_3){=}CH_2 \quad \text{(II)}$$

wherein $R_3$ represents a member selected from the group consisting of a hydrogen atom and a methyl radical and D represents a divalent group selected from those of the formulae:

$$-O-(CH_2CH(CH_3)O)_{n1}-,$$

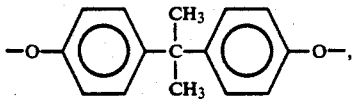

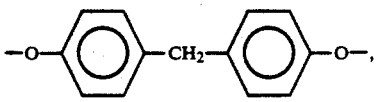

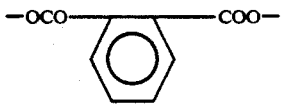

$$-OCO-(CH_2)_{n2}-COO-,$$

and $$-O-CH_2-C(CH_3)_2-CH_2-O-$$

wherein $n^1$ represents an integer of 1 to 4 and $n^2$ represents an integer of 2 to 14.

In the ingredient (c), the acrylic and methacrylic acid compounds (ii) having at least one hydroxyl group are preferably selected from 2-hydroxyethyl acrylate, 2-hydroxy-ethyl methacrylate, 2-hydroxypropyl acrylate, 2-hydroxypropyl methacrylate, and the compounds of the formulae (III) and (IV):

$$CH_2{=}CHCOO-CH_2CH(R_4)O-(OCCH_2CH_2CH_2CH_2CH_2O)_{n3}-H \quad \text{(III)}$$

and $$CH_2{=}CHCOOCH_2CH(R_5)OCO-R_6-COOCH_2CH(R_5)OH \quad \text{(IV)}$$

in which formulae (III) and (IV), $R_4$ and $R_5$, respectively and independently from each other, represent a member selected from the group consisting of a hydrogen atom and a methyl radical, $n^3$ represents 0 or an integer of 1 to 5, and $R_6$ represents a divalent group selected from those of the formulae:

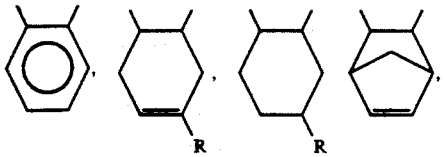

-continued

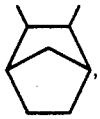

, $-CH_2CH_2-$ and $-CH{=}CH-$, in which formulae R represents a member selected from the group consisting of a hydrogen atom and a methyl radical.

Also, the other unsaturated acrylic and methacrylic ester compounds of the second component (B) have a divalent bisphenol A residue of the formula:

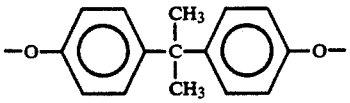

at least one divalent ethylene glycol residue of the formula:

$$\leftarrow CH_2CH_2O \rightarrow$$

and at least two unsaturated terminal radicals selected from acrylic and methacrylic ester chain structures of the formulae:

$$-COCH_2{=}CH_2$$

and $$-CO-C(CH_3){=}CH_2$$

The unsaturated acrylic and methacrylic compounds of the second component (B) having the above-mentioned chain structures are preferably selected from those of the formulae (V) and (VI):

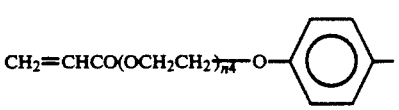

(V)

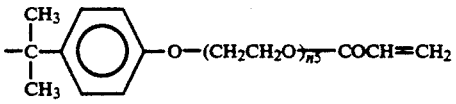

and

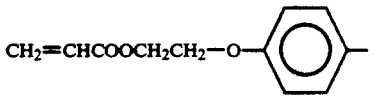

(VI)

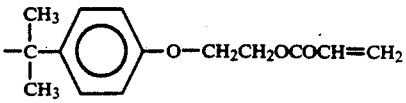

wherein $n^4$ and $n^5$, respectively and independently from each other, represent an integer of 1 to 3 and the sum of $n^4$ and $n^5$ ($n^4+n^5$) is 4.

The above-mentioned compounds of the formulae (V) and (VI) are available under the trademarks of R-551 from Nihon Kayaku Kogyo K.K., and of AM-556 or AM548 from AKZO RESIN K.K., respectively.

In the precursory resinous composition usable for the present invention, the first component (A) is preferably present in a weight ratio to the component (B) of 60:40 to 94:6, more preferably from 70:30 to 90:10.

The precursory resinous composition usable for the present invention optionally further comprises, in addition to the first and second components (A) and (B), a third component (C) consisting of at least one member selected from unsaturated acrylic and methacrylic ester compounds having a single unsaturated terminal radical selected from acrylic and methacrylic ester residues of the formulae:

$$-CO-CH=CH_2$$

and $$-CO-\overset{\overset{CH_3}{|}}{C}=CH_2$$

and other than the unsaturated acrylic and methacrylic compounds of the first and second components (A) and (B).

The component (C) effectively lowers the viscosity of a solution of the precursory resinous composition used as a coating liquid to form an image-receiving resinous layer.

The unsaturated acrylic and methacrylic compounds of the third component (C) are preferably selected from isopropyl acrylate and methacrylate, isobutyl acrylate and methacrylate, tert-butyl acrylate and methacrylate, cyclohexyl acrylate and methacrylate, β-hydroxyethyl acrylate and methacylate, methoxybutyl acrylate and methacrylate, polyethylene glycol acrylate and methacrylate, β-hydroxypropyl acrylate and methacrylate, 2-cyanoethyl acrylate and methacrylate, benzoyloxyethyl acrylate and methacrylate, benzyl acrylate and methacrylate, phenoxyethyl acrylate and methacrylate, 2-hydroxy-3-phenoxypropyl acrylate and methacrylate, tetrahydrofurfryl acrylate and methacrylate, isobornyl acrylate and methacrylate, and dicyclopentenyloxyethyl acrylate and methacrylate.

When the precursory resinous composition comprises the first, second and third components (A), (B) and (C), the first components (A) is preferably present in a weight ratio to the sum of the second and third component (B) and (C) of 60:40 to 94:6, more preferably 70:30 to 90:10.

When the weight ratio of the first component (A) to the other components (B) or (B) and (C) is more than 94:6, the resultant precursory resinous composition liquid to be coated on the substrate sheet sometimes exhibits a too high viscosity, and thus it is difficult to uniformly apply same to the substrate sheet.

Also, if the weight ratio of the first component (A) is less than 60:40, the resultant precursory resinous composition sometimes exhibits an unsatisfactory curing rate during the actinic ray irradiation curing procedure and the resultant image-receiving resinous layer sometimes exhibits a poor dye-receiving activity, and thus the thermal transferred colored images have an increased color density (darkness).

Also, the weight ratio of the second component (B) to the third component (C) in the precursory resinous composition is preferably more than 10:90, more preferably from 90:10 to 10:90, still more preferably from 80:20 to 20:80.

The precursory resinous composition usable for the present invention optionally further comprises 2% to 20%, based on the total weight thereof, of at least one silicone compound curable by an actinic ray irradiation.

The addition of the silicone compound to the precursory resinous composition imparts an improved releasability to the resultant image-receiving resinous layer surface, and this improved releasability effectively ensures the smooth travel of the image-receiving sheet and prevents a blockage of the printer due to an adhering of the image-receiving sheets to each other.

When the content of the silicone compound is less than 2% by weight, the releasability and blockage-preventing property of the resultant image-receiving sheet are sometimes unsatisfactory. Also, an addition of the silicone compound in the large amount of more than 20% by weight does not effectively further increase the releasability and the blockage-preventing property of the resultant image-receiving sheet, and thus is often an economical disadvantage.

The silicone compound usable for the present invention preferably has at least one divalent siloxane group of the formula:

$$-\overset{\overset{CH_3}{|}}{\underset{\underset{CH_3}{|}}{Si}}-O-$$

located in a backbone chain thereof and at least one terminal group selected from acryloyl, methacryloyl, vinyl and mercapto radicals.

The silicone compounds curable by an actinic ray irradiation are preferably selected from:

(1) reaction products of a siloxane compound with acrylic or methacrylic acid (2) reaction products of a siloxane compound with an isocyanate compound and acrylic or methacrylic acid, and (3) mixtures of a siloxane compound having a vinyl radical with a siloxane compound having a mercapto radical.

The curable silicone compound preferably selected from 1,3-bis(3-methacryloxy-propyl)-1,1,3,3-tetramethyl disiloxane, α, ω-bis(mercaptomethyl)-polydimethylsiloxane, α, ω-bis(vinyl)polydimethylsiloxane, 1,3-bis(mercaptomethyl)-1,1,3,3'-tetramethyldisiloxane and α, ω-bis(3-mercaptopropyl)polydimethylsiloxane.

The precursory resinous composition usable for forming the image-receiving resinous layer optionally further comprises at least one additive, for example, a pigment, a dye, a filler and others, or is free from the additive to thereby cause the resultant image-receiving resinous layer to be colorless and transparent.

The precursory resinous composition to be converted to a cured resinous material usually contains a photochemical initrator preferably in an amount of 0.1 to 10% based on the total weight of the precursory resinous composition. The photochemical initiator preferably comprises at least one member selected from mixtures of a benzophenone compound with an amine compound mixtures of a thioxanthone compound with an amine compound, and acetophenone compounds, ketal compounds and benzoinether compounds.

The substrate sheet usable for the present invention can be selected from conventional sheets usable for the conventional image-receiving sheets, for example, fine paper sheets, coated paper sheets, synthetic paper sheets consisting of at least one biaxially oriented film comprising a polyolefin resin, for example, a polyethylene resin, polypropylene resin or ethylene-propylene copolymer and an inorganic pigment, for example, titanium dioxide, calcium carbonate and clay, and laminate sheets composed of two or more of the above-mentioned sheets.

Preferably, the substrate sheet has a thickness of 20 to 250 μm and a basis weight of 20 to 250 g/m$^2$.

In the production of the image-receiving sheet of the present invention, a precursory resinous composition-coating liquid is coated on a surface of the substrate sheet by a customary coating method, for example, bar-coating method, air coating method, doctor blade coating method, squeeze coating method, air-knife coating method, reverse roll coating method or transfer coating method.

The precursory resinous composition-coating liquid is applied to a thickness that will provide a cured resinous composition layer having a desired thickness, on the substrate sheet surface.

The resultant precursory resinous material layer is subjected to an actinic ray irradiation. The actinic rays are either electon beams or ultraviolet rays. When electron beams are used as the actinic energy rays for the curing, a curtain beam type electron beam-accelerator, which is relatively cheap and can generate a large output, can be utilized. In the curtain beam type accelerator, usually the accelerating voltage is from 100 to 300 k volts and the absorbed dose is from 0.5 to 10 Mrad.

Also, the actinic ray irradiation is preferably carried out in an atmosphere in which the oxygen content is restricted to 500 ppm or less. When the oxygen content is more than 500 ppm, the oxygen serves as a polymerization (curing) retardant, and thus the precursory resinous composition is not sufficiently cured.

In the curing procedure, the actinic rays can be directly applied to the precursory resinous composition layer on the substrate sheet. Alternatively, the precursory resinous composition layer on the substrate sheet can be brought into contact with a peripheral surface of a cast drum, under a certain pressure, and the actinic rays applied to the precursory resinous composition layer through the substrate sheet.

Usually, the thickness of the resultant cured image-receiving resinous layer is from 2 to 20 μm. When the thickness is less than 2 μm, the resultant image-receiving resinous layer sometimes exhibits an unsatisfactory sensitivity, and thus the received images have a reduced color density (darkness). Also, it is very difficult to evenly form a very thin layer at a thickness of less than 2 μm, and the uneven layer causes an uneven quality of the received images.

An increase in the thickness of the image-receiving resinous layer to more than 20 μm does not contribute to an enhancing of the sensitivity of the image-receiving resinous layer, or to an increase of the color density of the received images, and thus is economically disadvantageous.

EXAMPLES

The present invention will be further explained by the following specific examples, which are representative and do not in any way restrict the scope of the present invention.

In the examples, the image-receiving property of the image receiving sheet was tested and evaluated in the following manner.

In a thermal transfer dye image-printer (available under the trademark of PRINTER VP6000, from Fuji Film Co.), an image-receiving sheet was printed in a black color in accordance with a step pattern supplied from a color bar signal generator (available under the trademark of GENERATOR C12A2, from K. K. SIBBZOG) by superimposing yellow, magenta and cyan images one on the other.

In the black colored images printed in a 16 step pattern, the color density (darkness) of the sixteenth tone images was measured by using a color density tester (available under the trademark of MACBETH RD-914, from Kollmorgen Corp.). Also the hue by the black colored images was evaluated by naked eye-observation.

The above-mentioned measurement and evaluation procedures were applied to the colored images immediately after the printing operation, and after the printed sheet was subjected to a heat treatment at a temperature of 60° C. for 240 hours.

SYNTHESIS EXAMPLE 1

Preparation of Unsaturated Acrylic Ester Compound (A) Having a Rosin Residue

A mixture consisting of 31.6 parts by weight of dehydroabietic acid, 63.3 parts by weight of epichlorohydrin and 0.03 part by weight of benzyltrimethyl ammonium was placed in a reaction vessel and converted to a solution by a stirring operation. The mixture as a solution was subjected to a reaction by heating at a temperature of 80° C. for 4 hours.

The resultant reaction mixture was added stepwise with 5.07 parts by weight of granular sodium hydroxide and then subjected to a further reaction at a temperature of 100° C. for 2 hours while stirring. After the reaction was completed, the deposited sodium chloride particles were removed by filtering, the filtrate was subjected to an evaporation process by a rotary evaporator, to distill away the non-reacted epichlorohydrin, and the resultant product then was treated at a temperature of 120° C. under a reduced pressure of 2 mmHg, to completely eliminate a volatile fraction from the product.

The resultant product was rosin glycidyl-ester.

A reaction vessel was charged with a reaction mixture consisting of 2568 parts by weight (5.81 moles) of rosin glycidylester, 427 parts by weight (5.81 moles) of 98% acrylic acid, 3.0 parts by weight (1000 ppm based on the entire amount of the reaction mixture) of an esterification catalyst consisting of benzyltrimethyl ammonium chloride, and a polymerization inhibitor consisting of 3.0 parts by weight of 4-methoxyphenol and 3.0 parts by weight of phenothiazine. The reaction mixture was subjected to a reaction at a temperature of 105° C. to 110° C. for 6 hours, while flowing a nitrogen gas through the reaction vessel.

A reaction product of acrylic acid with rosin glycidylester corresponding to the ingredient (a).

A mixture of 2178.8 parts by weight (4.20 moles) of the ingredient (a) consisting of the acrylic acid - rosin glycidylester reaction product, 933.6 parts by weight (4.20 moles) of an ingredient (b) consisting of isophoronediisocyanate, 487.8 parts by weight (4.20 moles) of an ingredient (c) consisting of 2-hydroxyethyl acrylate (2-HEA), a diluting agent consisting of 189.7 parts by weight of phenoxyethylacrylate and a polymerization inhibitor consisting of 3.6 parts by weight (1000 ppm) of 4-emethoxyphenol, was gradually heated to 75° C. and then maintained at a temperature of 75° C. to 80° C. for 12 hours, while stirring. Then to the reaction mixture was further added a urethane-formation catalyst consisting of 1.4 parts by weight (400 ppm) of stannous octonate, the mixture was heated at a temperature of 75° C. to 80° C. for 5 hours.

The reaction product was a mixture of an unsaturated acrylate resin (A) having a rosin residue and phenoxyethyl acrylate in a mixing weight ratio of 95:5.

EXAMPLE 1

An image-receiving sheet was prepared as follows.

(1) Preparation of Coating Liquid for Image-Receiving Resinous Layer

A coating liquid was prepared in the following composition.

| Component | Part by weight |
|---|---|
| Rosin residue-containing acrylate resin (A) | 86 |
| Phenoxyethyl acrylate | 10 |
| Bisphenol A diethyleneglycol diacrylate(*)1 | 4 |
| 1,3-bis(3-methacryloxypropyl)-1,1,3,3-tetramethylsiloxane(*)2 | 5 |

Note:
(*)1The compound of the formula (VI), available under the trademark of AM546, from AKZO RESIN CO.
(*)2Available under the trademark of TSL9706, from Toshiba Silicone K.K.

(2) Formation of Image-Receiving Resinous Layer

The resultant coating liquid was heated at a temperature of 60° C. and coated on a surface of a substrate sheet consisting of a pigment-coated paper sheet made by OJI PAPER CO. and having a thickness of 150 μm, by using a coating bar, to form an image-receiving resinous layer having a dry solid weight of 10 g/m$^2$.

The coating liquid layer on the substrate sheet was exposed to an electron beam irradiation at an absorbed dose of 4 Mrad, to provide a cured resinous layer, whereby an image-receiving sheet with a cured image-receiving resinous layer was obtained.

The test results are shown in Table 1.

EXAMPLE 2

The same procedures as in Example 1 were carried out, except that the coating liquid for the image-receiving resinous layer was prepared in the following composition.

| Component | Part by weight |
|---|---|
| Rosin residue-containing acrylate resin (A) | 86 |
| Phenoxyethyl acrylate | 10 |
| Bisphenol A tetraethyleneglycol diacrylate(*)3 | 4 |
| 1,3-bis(3-methacryloxypropyl)-1,1,3,3-tetramethylsiloxane (TSL9706) | 5 |

Note:
(*)3The compound of the formula (V), available under the trademark of BS750, fro Aradawa Kagaku K.K.

The test results are shown in Table 1.

COMPARATIVE EXAMPLE 1

The same procedures as in Example 1 were carried out, except that the coating liquid for the image-receiving resinous layer had the following composition.

| Composition | Part by weight |
|---|---|
| Rosin residue-containing acrylate resin (A) | 86 |
| Phenoxyethyl acrylate | 10 |
| Bisphenol F tetraethyleneglycol diacrylate*4 | 4 |
| 1,3-bis(3-methacryloxypropyl)1,1,3,3-tetramethylsiloxane (TSL 9706) | 5 |

Note:
*4. . . A compound of the formula (VII):

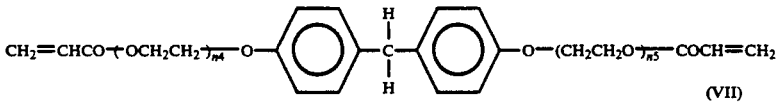

(VII)

wherein n$^4$ and n$^5$ are as defined above, available under the trademark of R712, from NIHON KAYAKU KOGYO K.K.

The test results are shown in Table 1.

COMPARATIVE EXAMPLE 2

The same procedures as in Example 1 were carried out, except that the coating liquid for the image-receiving resinous sheet had the following composition.

| Component | Part by weight |
|---|---|
| Rosin residue-containing acrylate resin (A) | 86 |
| Phenoxyethyl acrylate | 10 |
| Bisphenol A epoxydiacrylate*5 | 4 |
| 1,3-bis(3-methacryloxypropyl)-1,1,3,3-tetramethylsiloxane (TSL 9706) | 5 |

Note:
*5. . . A compound of the formula (VIII):

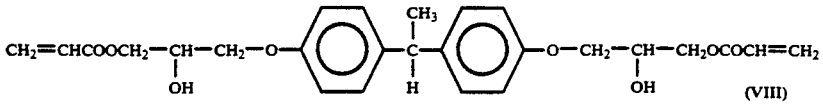

(VIII)

available under the trademark of BISCOAT 540, from OSAKA YUKIKAGAKU K.K.

The test results are shown in Table 1.

COMPARATIVE EXAMPLE 3

The same procedures as in Example 1 were carried out, except that the coating liquid for the image-receiving resinous layer had the following composition.

| Component | Part by weight |
|---|---|
| Rosin residue-containing acrylate resin (A) | 86 |
| Phenoxyethyl adrylate | 10 |
| Partially acryalte-modified bisphenol A-epoxymonoacrylate*6 | 4 |
| 1,3-bis(3-methacryloxypropyl)-1,1,3,3-tetramethylsiloxane (TSL 9706) | 5 |

Note:

*6. . . A compound of the fromula (IX):

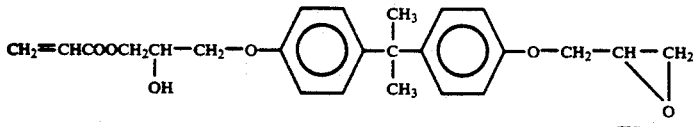

(IX)

available under the trademark of EBECRYL3605, from U.S.B. CO.

The test results are shown in Table 1.

COMPARATIVE EXAMPLE 4

The same procedures as in Example 1 were carried out, except that the coating liquid for the image-receiving resinous sheet had the following composition.

| Component | Part by weight |
|---|---|
| Rosin residue-containing acrylate resin (A) | 95 |
| Phenoxyethyl acrylate | 5 |
| 1,3-bis(3-methacryloxypropyl)-1,1,3,3-tetramethylsiloxane (TSL9706) | 5 |

The resultant coating liquid exhibited a very high viscosity, and thus could be coated on the substrate sheet.

TABLE 1

| | | Item | | | |
|---|---|---|---|---|---|
| | | Printed image | | | |
| | | Immediately after printing | | After heat treatment | |
| Examples | | Color density (darkness) | Hue | Color density (darkness) | Hue |
| Example | 1 | 1.60 | Black | 1.60 | Black |
| | 2 | 1.58 | Black | 1.58 | Black |
| Comparative | 1 | 1.52 | Black | 1.50 | Not black |
| Example | 2 | 1.46 | Black | 1.47 | Not black |
| | 3 | 1.53 | Black | 1.52 | Not black |
| | 4 | Impossible to coat due to high viscosity | | | |

We claim:

1. A thermal transfer image-receiving sheet comprising:

a substrate sheet and an image-receiving resinous layer formed on at least one surface of the substrate sheet and comprising, as a principal component, a resinous material cured by an actinic ray irradiation, said cured resinous material consisting of an actinic ray irradiation curing product of a precursor resinous composition comprising:

(A) a first component consisting of at least on member selected from reaction products of:

(a) an ingredient consisting of at least one reaction product of at least one member selected from acrylic acid and methacrylic acid with at least one rosin glycidylester, with (b) an ingredient consisting of at least one diisocyanate compound, and (c) an ingredient consisting of at least one member selected from:

(i) reaction products of at least one member selected from acrylic and methacrylic acids with at least one diepoxide compound, and (ii) acrylic and methacrylic ester compounds having at least one hydroxyl radical; and (B) a second component consistin of at least one member selected from the compounds of formulae (V) and (VI):

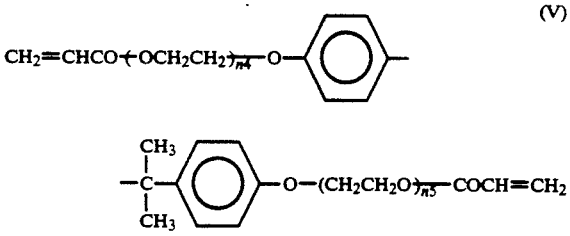

(V)

and

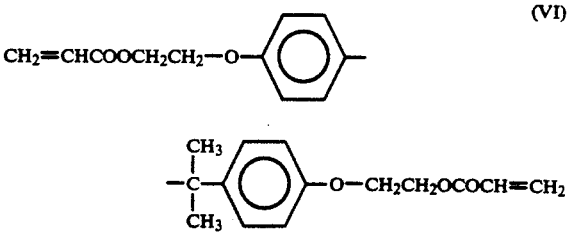

(VI)

wherein $r^4$ and $n^5$, respectively and independently from each other, represent an integer of 1 to 3 and the sum of $n^4$ and $n^5$ is 4, the second component (B) being different from the first component (A).

2. The image-receiving sheet as claimed in claim 1, wherein the ingredient (a) consists of at least one compound of the formula (I):

$$R_1-COOCH_2\underset{\underset{OH}{|}}{C}HCH_2OCO\overset{\overset{R_2}{|}}{C}=CH_2 \quad (I)$$

wherein $R_1$ represents a rosin residue, and $R_2$ represents a member selected from the group consisting of a hydrogen atom and a methyl radical.

3. The image-receiving sheet as claimed in claim 1, wherein the ingredient (b) consists of at least one member selected from the group consisting of diphenylmethane diisocyanate, isophorone diisocyanate, hexamethylene diisocyanate, phenylene diisocyanate, and tolylene diisocyanate.

4. The image-receiving sheet as claimed in claim 1, wherein the ingredient (c) consists of at least one member selected from the compounds of the formula (II):

$$CH_2=\overset{\overset{R_3}{|}}{C}COOCH_2\overset{\overset{OH}{|}}{C}HCH_2-D-CH_2\overset{\overset{OH}{|}}{C}HCH_2OCO\overset{\overset{R_3}{|}}{C}=CH_2 \quad (II)$$

wherein $R_3$ represents a member selected from the group consisting of a hydrogen atom and a methyl radial, and D represents a divalent group selected from those of the formulae:

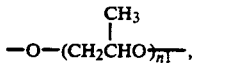

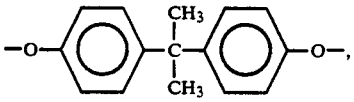

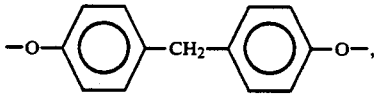

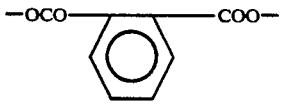

$-OCO-(CH_2)_{n2}-COO-$, and

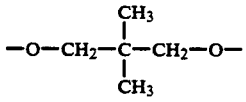

wherein $n^1$ represents an integer of 1 to 4 and $n^2$ represents an integer of 2 to 14, and 2-hydroxypropyl acrylate, 2-hydroxypropyl methacrylate, and the compounds of the formulae (III) and (IV):

$$CH_2=CHCOO-CH_2\overset{\overset{R_4}{|}}{C}HO-(OCCH_2CH_2CH_2CH_2CH_2O)_{n3}-H \quad (III)$$

and $$CH_2=CHCOOCH_2\overset{\overset{R_5}{|}}{C}HOCO-R_6-COOCH_2\overset{\overset{R_5}{|}}{C}HOH \quad (IV)$$

in which formulae $R_4$ and $R_5$ respectively and independently from each other, represent a member selected from the group consisting of a hydrogen atom and a methyl radical, $n^3$ represents zero or an integer of 1 to 5, and $R_6$ represents a divalent group selected from those of the formulae:

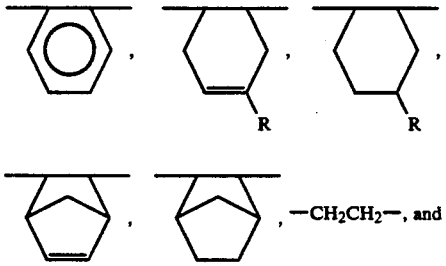

$-CH_2CH_2-$, and $-CH=CH-$, in which formulae: R represents a member selected from the group consisting of a hydrogen atom and a methyl radical.

5. The image-receiving sheet as a claimed in claim 1, wherein the first component (A) is present in a weight ratio of 60:40 to 94:6 to the component (B).

6. The image-receiving sheet as claimed in claim 1, wherein said precursor resinous composition further comprises, in addition to the first and second components (A) and (B), a third component (C) consisting of at least one member selected from unsaturated acrylic and methacrylic ester compounds having a single terminal radical selected from acrylic and methacrylic ester residues, and other than the unsaturated acrylic and methacrylate compounds of the components (A) and (B).

7. The image-receiving sheet as claimed in claim 6, wherein said unsaturated acrylic and methacrylic compounds of the third component (C) are selected from isopropyl acrylate and methacrylate, isobutyl acrylate and methacrylate, tert-butyl acrylate and methacrylate, cyclohexyl acrylate and methacrylate, β-hydroxyethyl acrylate and methacrylate, methoxybutyl acrylate and methacrylate, polyethylene glycol acrylate and methacrylate, β-hydroxypropyl acrylate and methacrylate, 2-cyanoethyl acrylate and methacrylate, benzoyloxyethyl acrylate and methacrylate, benzyl acrylate and methacrylate, phenoxyethyl acrylate and methacrylate, 2-hydroxy-3-phenoxypropyl acrylate and methacrylate, tetrahydrofurfryl acrylate and methacrylate, isobornyl acrylate and methacrylate, and discyclopentenyloxyethyl acrylate ,and methacrylate.

8. The image-receiving sheet as claimed in claim 6, wherein the first component (A) is present in a weight ratio of 60:40 to 94:6 to the sum components (B) and (C).

9. The image-receiving sheet as claimed in claim 1, wherein the precursor resinous composition further contains at least one silicone compound curable by the actinic ray irradiation.

10. The image-receiving sheet as claimed in claim 9, wherein the silicone compound has at least one divalent siloxane group of the formula:

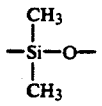

located in a backbone chain thereof and at least one terminal group selected from, acryloyl, methacryloyl, vinyl and mercapto radicals.

11. The image-receiving sheet as claimed in claim 9, wherein the silicone compound is selected from 1,3-bis(3-methacryloxy-propyl)-1,1,3,3-tetramethyl disiloxane, $\alpha,\omega$-bis(mercaptomethyl)polydimethylsiloxane, $\alpha,\omega$-bis(vinyl)polydimethylsiloxane, 1,3-bis(mercaptomethyl)-1,1,3,3'-tetramethyl-disiloxane and $\alpha$, $\omega$-bis(3-mercaptopropyl)polydimethylsiloxane.

12. The image-receiving sheet as claimed in claim 9, wherein the silicone compound is present in an amount of 2 to 20% based on the total weight of the precursory resinous composition.

* * * * *